US007473067B2

(12) United States Patent
Nishioka et al.

(10) Patent No.: US 7,473,067 B2
(45) Date of Patent: Jan. 6, 2009

(54) ATTACHMENT COUPLER

(75) Inventors: Takao Nishioka, Kaga (JP); Takashi Moriuchi, Komatsu (JP)

(73) Assignee: Kabushiki Kaisha Muroto Tekkosho (JP)

( * ) Notice: Subject to any disclaimer, the term of this patent is extended or adjusted under 35 U.S.C. 154(b) by 149 days.

(21) Appl. No.: 11/711,914

(22) Filed: Feb. 27, 2007

(65) Prior Publication Data

US 2008/0170933 A1 Jul. 17, 2008

(30) Foreign Application Priority Data

Jan. 16, 2007 (JP) ..... 2007-007507

(51) Int. Cl.
*E02F 3/96* (2006.01)

(52) U.S. Cl. ..... 414/723; 37/468

(58) Field of Classification Search ..... 414/723; 403/321, 322.1, 322.2; 37/468
See application file for complete search history.

(56) References Cited

U.S. PATENT DOCUMENTS 4,067,467 A 1/1978 Datta et al.
5,549,440 A * 8/1996 Cholakon et al. ..... 414/723
5,692,325 A * 12/1997 Kuzutani ..... 37/468

* cited by examiner

*Primary Examiner*—Donald Underwood
(74) *Attorney, Agent, or Firm*—Harness, Dickey & Pierce, P.L.C.

(57) ABSTRACT

An attachment coupler includes a first arm and a second arm, each including a U-shaped portion, and upper portions of the first and second arms being swingably connected by a swing shaft, and an expansion-contraction tool which opens and closes the first and second arms around the swing shaft as a fulcrum. A locking member provided with a cam and a hook provided with a cam follower are rotatably provided on the second arm. A state in which a free end of the hook is removed from an opening of the U-shaped portion is maintained by engagement of the cam and the cam follower during contraction of the expansion-contraction tool. The cam follower is driven by the cam along with rotation of the locking member during expansion of the expansion-contraction tool, thereby causing the free end of the hook to advance toward the opening of the U-shaped portion.

7 Claims, 11 Drawing Sheets

ATTACHMENT COUPLER

Japanese Patent Application No. 2007-007507 filed on Jan. 16, 2007, is hereby incorporated by reference in its entirety.

BACKGROUND OF THE INVENTION

The present invention relates to a coupler for attaching, removing, or replacing an attachment such as a bucket, a clamshell bucket, or a vibration crusher which is secured to the end of an arm of a working machine such as a power shovel.

A working machine (e.g. power shovel) widely used for engineering work must be provided with various attachments such as a clamshell bucket or a vibration crusher instead of a bucket depending on the type of work.

In a small-scale construction site, it is generally necessary to carry out various types of work utilizing one power shovel. In such construction work, the attachment must be replaced each time the type of work changes.

An attachment coupler has been used in order to easily and quickly perform the replacement operation.

For example, a conventional coupler shown in FIG. 10 includes a base 120A and a slider 130A, and is attached to a power shovel by pivotally attaching the base portion of the coupler to a front link 82 and an arm 81 using pins 121 and 131.

A conventional coupler shown in FIG. 11 includes a link plate 120B and a link plate 130B, and is attached to a power shovel by pivotally attaching the base portion of the coupler to the front link 82 and the arm 81 using the pins 121 and 131.

U-shaped portions 122 and 132 which face each other (FIG. 10) or face in opposite directions (FIG. 11) are provided on the end of the coupler, and an expansion-contraction tool 140 such as a screw rod or a hydraulic cylinder is provided for adjusting the distance between the U-shaped portions 122 and 132.

Pins 2 and 3 are provided in advance to an attachment 1 such as a bucket. The pins 2 and 3 of the bucket are inserted into the U-shaped portions 122 and 132. The bucket 1 is secured by applying a pulling force (FIG. 10) or a separating force (FIG. 11) using the expansion-contraction tool 140.

In the coupler having such a structure, an abnormal force may be applied to the pins or the U-shaped portions 122 and 132 when foreign matter enters the U-shaped portions 122 and 132, whereby the coupler may break or the pins 2 and 3 of the attachment 1 may be removed from the U-shaped portions 122 and 132. In the worst case, the attachment 1 falls, thereby endangering the workers.

U.S. Pat. No. 4,067,467 discloses technology of securing an attachment by engaging posts provided on the ends of an arm and a front link with sockets provided in a bucket. However, since a dedicated engagement structure must be provided to the coupler and the attachment, this technology lacks versatility and results in poor workability.

SUMMARY

According to one aspect of the invention, there is provided an attachment coupler comprising:

a first arm and a second arm, each of the first arm and the second arm including a U-shaped portion provided on a lower end and having a U-shaped cross section and a pivot shaft provided on an upper side of the U-shaped portion, and upper portions of the first arm and the second arm being swingably connected by a swing shaft;

an expansion-contraction tool of which one end is rotatably supported by the pivot shaft of the first arm and the other end is supported by the pivot shaft of the second arm, and which opens and closes the first arm and the second arm around the swing shaft as a fulcrum due to expansion and contraction;

a locking member which moves rotationally around the pivot shaft of the second arm along with rotation of the expansion-contraction tool, is rotationally biased in a rotational direction around the pivot shaft of the second arm during contraction of the expansion-contraction tool, and includes a cam formed in a peripheral portion; and a hook which includes a base end rotatably supported by the second arm, a free end which advances toward and retreats from an opening of the U-shaped portion of the second arm, and a cam follower which is provided on a peripheral portion between the base end and the free end and contacts the cam;

wherein a state in which the free end of the hook is removed from the opening of the U-shaped portion of the second arm is maintained by engagement of the cam and the cam follower during contraction of the expansion-contraction tool; and wherein the cam follower is driven by the cam along with rotation of the locking member during expansion of the expansion-contraction tool, thereby causing the free end of the hook to advance toward the opening of the U-shaped portion of the second arm.

DETAILED DESCRIPTION OF THE EMBODIMENT

Figure 1A:
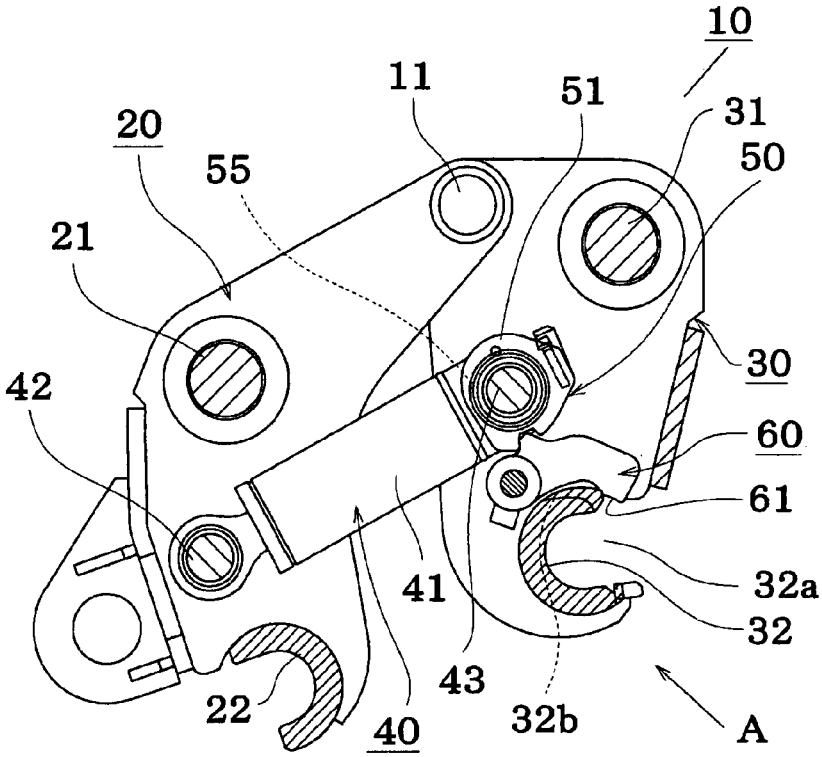
FIGS. 1A and 1B are explanatory diagrams showing the structure of an attachment coupler according to the invention.

The invention has been achieved in view of the above technical problems. An object of the invention is to provide a working machine attachment coupler which exhibits excellent attachment connection safety and is easily attached and removed.

The invention provides an attachment coupler comprising:

a first arm and a second arm, each of the first arm and the second arm including a U-shaped portion provided on a lower end and having a U-shaped cross section and a pivot shaft provided on an upper side of the U-shaped portion, and upper portions of the first arm and the second arm being swingably connected by a swing shaft;

an expansion-contraction tool of which one end is rotatably supported by the pivot shaft of the first arm and the other end is supported by the pivot shaft of the second arm, and which opens and closes the first arm and the second arm around the swing shaft as a fulcrum due to expansion and contraction;

a locking member which moves rotationally around the pivot shaft of the second arm along with rotation of the expansion-contraction tool, is rotationally biased in a rotational direction around the pivot shaft of the second arm during contraction of the expansion-contraction tool, and includes a cam formed in a peripheral portion; and a hook which includes a base end rotatably supported by the second arm, a free end which advances toward and retreats from an opening of the U-shaped portion of the second arm, and a cam follower which is provided on a peripheral portion between the base end and the free end and contacts the cam.

In the attachment coupler according to the invention, a state in which the free end of the hook is removed from the opening of the U-shaped portion of the second arm may be maintained by engagement of the cam and the cam follower during contraction of the expansion-contraction tool.

The cam follower may be driven by the cam along with rotation of the locking member during expansion of the expansion-contraction tool, thereby causing the free end of the hook to advance toward the opening of the U-shaped portion of the second arm. According to the invention, when expanding the expansion-contraction tool and holding connecting pins of an attachment in the U-shaped portions of the first and the second arms, removal of the connecting pin can be prevented by the free end of the hook.

When foreign matter or the like exists in the U-shaped portion of the second arm, the connecting pin of the attachment may not completely enter the U-shaped portion. In the invention, the locking member is biased so that the locking member can be freely rotated around the pivot shaft of the expansion-contraction tool. Therefore, the locking member can rotate against the biasing force in the direction opposite to the rotational direction of the expansion-contraction tool. Therefore, the invention can prevent breakage of the locking member or the latch depression of the hook.

Moreover, since the rotation of the locking member is recovered by the biasing force when the foreign matter is removed so that the protruding portion of the hook protrudes into the opening of the U-shaped portion, excellent attachment connection safety is achieved.

In the invention, the cam may include a depression, and the cam follower may include a latch protrusion which enters the depression of the locking member in a state in which the expansion-contraction tool is contracted.

In the invention, the cam may further include a stopper protrusion and a locking protrusion, and the depression may be formed between the stopper protrusion and the locking protrusion. In this case, the latch protrusion which has entered the depression of the locking member in a state in which the expansion-contraction tool is contracted contacts the stopper protrusion to restrict rotation of the hook. The latch protrusion which has been removed from the depression of the locking member in a state in which the expansion-contraction tool is expanded is pressed by the locking protrusion to cause the free end of the hook to advance toward the opening of the U-shaped portion of the second arm.

In the invention, it is preferable that the hook be rotationally biased in a direction in which the free end moves away from the opening of the U-shaped portion of the second arm. This allows the backward movement of the hook to be realized independent of the connecting pin removed from the U-shaped portion.

In the invention, the attachment coupler may comprise a torsion spring of which one end is supported by a spring mounting portion provided on the expansion-contraction tool and the other end is supported by the locking member. This allows the rotation of the locking member to be synchronized with the rotation of the expansion-contraction tool. Moreover, the locking member can be rotationally biased.

In the invention, it is preferable that the torsion spring go around the pivot shaft of the second arm. This enables the torsion spring to be disposed compactly.

In the invention, each of the first arm and the second arm may include a connecting portion respectively connected to an arm and a front link of a working machine.

Embodiments of the attachment coupler according to the invention are described below in detail with reference to the drawings.

Figure 1B:
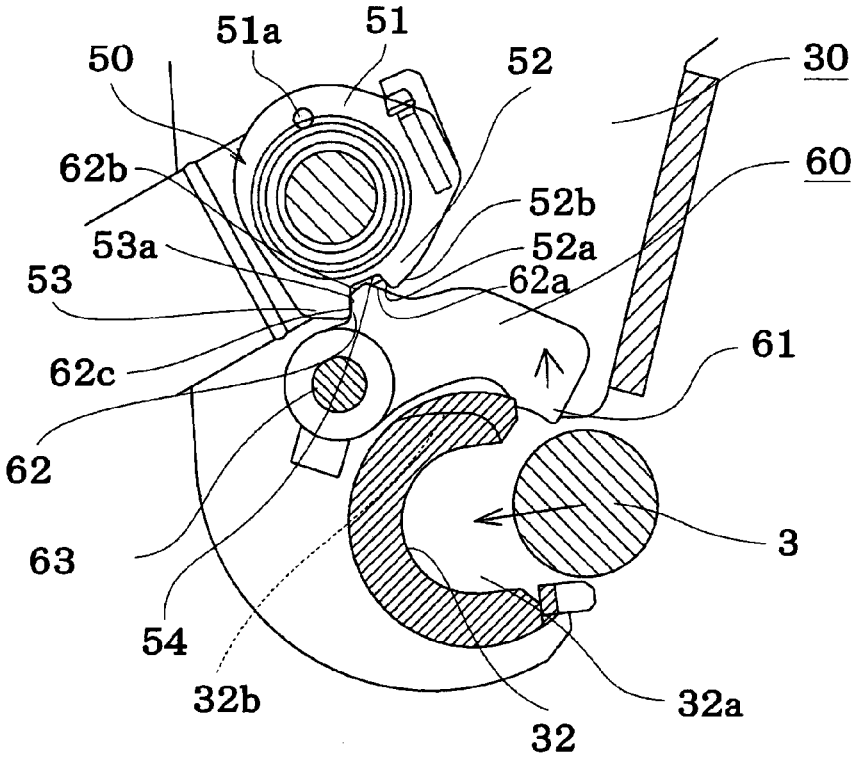
Figure 3A:
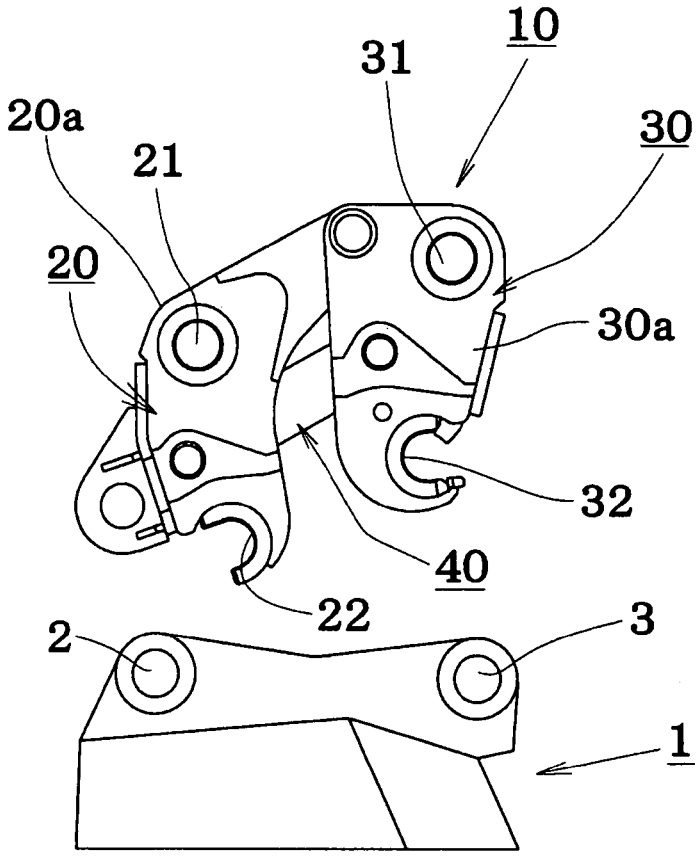
FIGS. 3A and 3B show the outward appearance of a coupler and the relationship with an attachment.
Figure 3B:
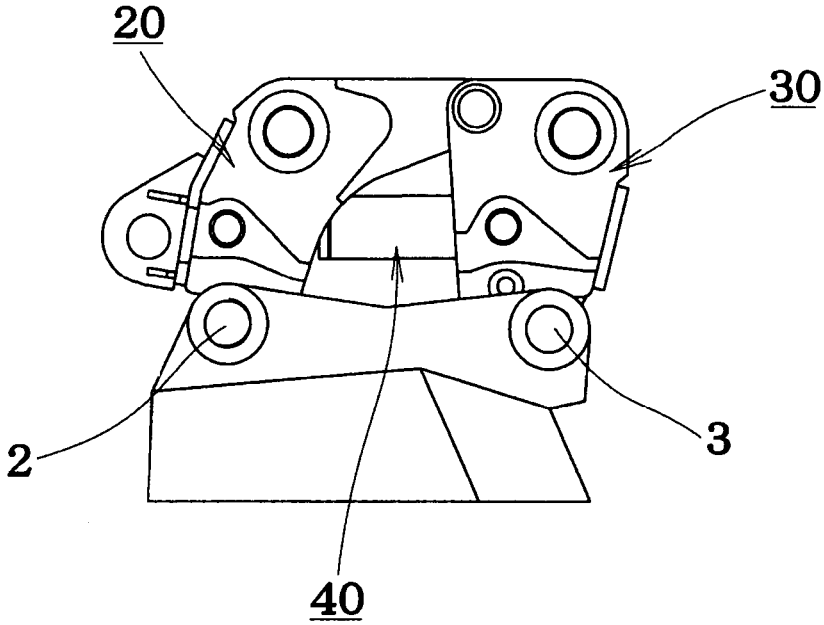
Figure 6:
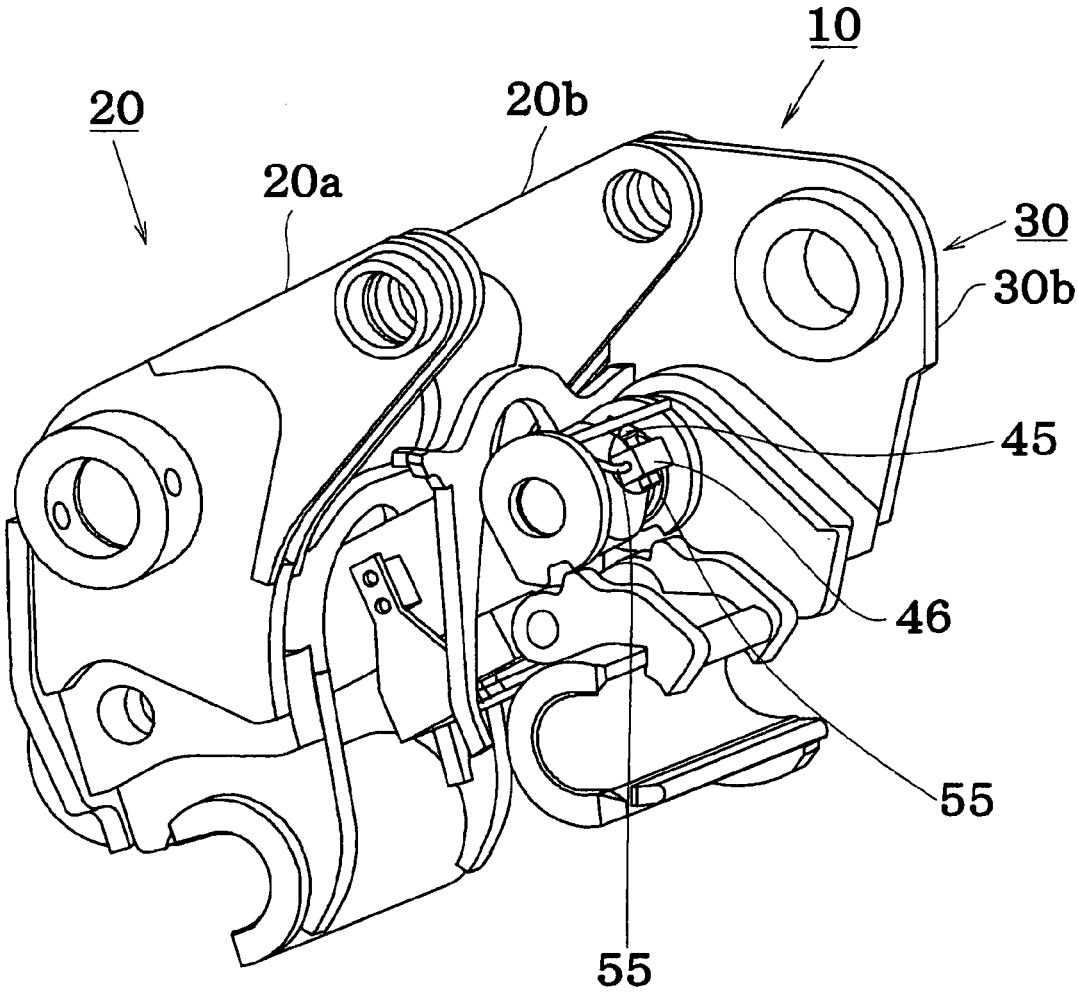
FIG. 6 is an oblique explanatory diagram showing a coupler.

FIGS. 3A and 3B are outside views of the attachment coupler (hereinafter simply called "coupler") according to the invention, FIG. 1A is a structural explanatory diagram in which the front side of a coupler 10 is removed, FIG. 1B is an enlarged explanatory diagram corresponding to the section A, and FIG. 6 is an internal oblique explanatory diagram in which a second link plate 30*a* and the like on the front side of a second arm 30 of the coupler 10 are removed.

In the coupler 10, the upper portions of a first arm 20 and a second arm 30 are connected using a fulcrum pin 11 which serves as a swing shaft.

As shown in FIG. 6, the first arm 20 is formed by connecting two first link plates 20*a* and 20*b* using a connecting pin 21, and the second arm 30 is formed by connecting two second link plates 30*a* and 30*b* using a connecting pin 31 (the second link plate 30*b* is omitted in FIG. 6).

The connecting pin 21 of the first arm 20 and the connecting pin 31 of the second arm 30 are pivotally attached respectively to a front link (not shown) and an arm (not shown) of a power shovel or the like.

U-shaped portions 22 and 32 to which pins 2 and 3 of an attachment 1 such as a bucket are respectively connected and secured are provided in the lower portions of the first and second arms 20 and 30 in opposite directions.

An expansion-contraction tool 40 is provided between the first and second arms 20 and 30 to have a trunnion structure by providing pivot shafts 42 and 43 on either end.

The expansion-contraction tool 40 allows the distance between the pair of U-shaped portions to be increased or decreased around the fulcrum pin 11 as the swing shaft by driving a hydraulic cylinder 41 provided between the pivot shafts 42 and 43.

FIGS. 1A and 1B show a state in which the expansion-contraction tool 40 is contracted to the maximum.

As shown in FIGS. 3A and 3B, the following steps are required when attaching the attachment 1 such as a bucket to the coupler 10 attached to a power shovel. The expansion-contraction tool 40 is contracted until the state shown in FIG. 1 is achieved to reduce the distance between the U-shaped portions 22 and 32 so that the U-shaped portions 22 and 32 are positioned between the pins 2 and 3 of the bucket. When expanding the expansion-contraction tool 40, the U-shaped portion 22 contacts the inner side of the pin 2, and the U-shaped portion 32 contacts the inner side of the pin 3. When further expanding the expansion-contraction tool 40, a separating force acts between the pair of U-shaped portions 22 and 32, whereby the attachment 1 is secured to the power shovel.

The base of a hook 60 is pivotally attached to the U-shaped portion 32 of the second arm 30 using a shaft 63 parallel to the pivot shaft 43 of the expansion-contraction tool 40. The hook 60 includes a protruding portion (free end) 61 which approaches and retreats from an opening 32*a* of the U-shaped portion 32, and a latch protrusion 62 having a cam follower shape which protrudes toward a locking member 50 described later.

The locking member 50 having a ring 51 is attached to the pivot shaft 43 of the expansion-contraction tool 40 on the second arm 30 side coaxially with the pivot shaft 43.

As shown in FIGS. 1A and 1B, a torsion spring 55 which goes around the pivot shaft 43 is provided in a state in which one end is secured to a spring mounting portion 46 shown in FIG. 6 and the other end is connected with the ring 51 of the locking member 50 shown in FIG. 1A. The spring mounting portion 46 is provided on the expansion-contraction tool 40. As the cam shape of the circular peripheral portion of the ring 51 of the locking member 50, a depression 54 is formed in which the latch protrusion 62 of the hook 60 is positioned in a state in which the expansion-contraction tool 40 is contracted to the maximum, as shown in FIG. 1B.

The protruding portion 61 of the hook 60 is biased in the direction in which the protruding portion 61 moves away from the opening 32*a* of the U-shaped portion 32 provided in the second arm 30. When the expansion-contraction tool 40 is contracted, as shown in FIG. 1B, the latch protrusion 62 of the hook 60 enters the depression 54 of the locking member 50, and the protruding portion 61 of the hook 60 moves backward in the direction indicated by the arrow in FIG. 1B.

As the backward biasing method, various methods such as a spring, hydraulic pressure, air pressure, and weight may be employed.

The hook 60 need not necessarily be biased in the direction in which the protruding portion 61 moves backward. Specifically, the hook 60 is pressed by the connecting pin 3 of the attachment 1 along with expansion of the expansion-contraction tool to move away from the opening 32*a* of the U-shaped portion 32.

An operation in which the pin 3 of the attachment enters the U-shaped portion 32 so that the attachment is secured to the coupler is described below with reference to FIGS. 1B, 2A, and 2B.

In FIG. 1B, the expansion-contraction tool 40 is contracted so that the distance between the U-shaped portion 22 of the first arm 20 and the U-shaped portion 32 of the second arm 30 becomes smaller than the distance between the pins 2 and 3 of the attachment 1. FIG. 3A shows this state.

The state shown in FIG. 1B is achieved by causing the U-shaped portion 22 of the first arm 20 to face the pin 2 of the attachment 1 and causing the U-shaped portion 32 of the second arm 30 to face the pin 3 of the attachment 1.

In this state, the position of the depression 54 formed in the peripheral portion of the ring 51 of the locking member 50 coincides with the position of the latch protrusion 62 of the hook 60. Since the hook 60 is biased in the direction indicated by the arrow in FIG. 1B, the latch protrusion 62 enters the depression 54 of the ring 51. This causes the protruding portion 61 of the hook 60 to move away from the opening 32*a* of the U-shaped portion 32, whereby the pin 3 enters the opening 32*a* of the U-shaped portion 32.

When the latch protrusion 62 has entered the depression 54 of the ring 51, a stopper contact portion 62*c* formed on the side of the latch protrusion 62 contacts a stopper surface 53*a* of a stopper protrusion 53 provided to form the depression 54.

When expanding the expansion-contraction tool 40 from the state shown in FIG. 1B, since both ends of the expansion-contraction tool 40 are pivotally attached to the first arm 20 and the second arm 30, the space between the U-shaped portion 22 of the first arm 20 and the U-shaped portion 32 of the second arm 30 is increased around the fulcrum pin 11 as the swing shaft. The arms are rotated in the direction in which the expansion-contraction tool 40 is positioned horizontally (see FIG. 2B). In this operation, the ring 51 of the locking member 50 is rotated clockwise, as indicated by the arrow in FIG. 2A, while being biased by the torsion spring 55.

When the ring 51 is rotated clockwise, a hook portion 62*a* (see FIG. 1B) formed on the side of the latch protrusion 62 of the hook is pressed by a hook portion 52*a* (see FIG. 1B) on the side of a locking protrusion 52 formed by the depression 54 formed in the ring 51. A restriction portion 62*b* (see FIG. 2A) provided at the top of the latch protrusion 62 is then pressed by a locking surface 52*b* (see FIG. 2A) of the locking protrusion 52.

Figure 2A:
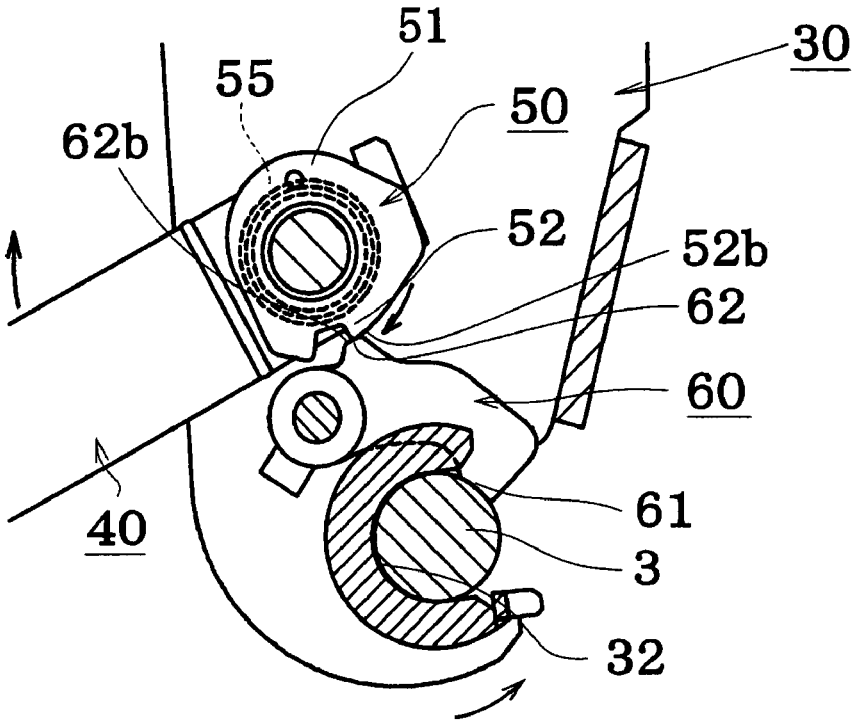
FIGS. 2A and 2B are explanatory diagrams showing an operation when securing an attachment to a coupler.
Figure 2B:
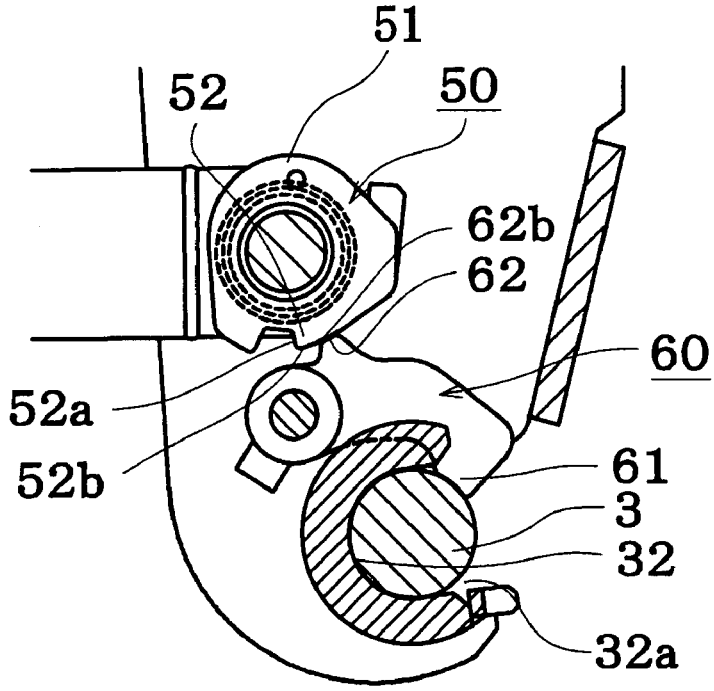

The hook 60 thus pressed is rotated so that the protruding portion 61 protrudes into the U-shaped portion 32, as shown in FIG. 2A, to close the opening 32*a* of the U-shaped portion. When further expanding the expansion-contraction tool 40, the locking surface 52*b* of the locking protrusion 52 of the ring 51 slidingly contacts and presses the restriction portion 62*b* which is the top portion of the latch protrusion 62, as shown in FIG. 2B, to prevent the protruding portion 61 of the hook 60 from moving backward.

Figure 7:
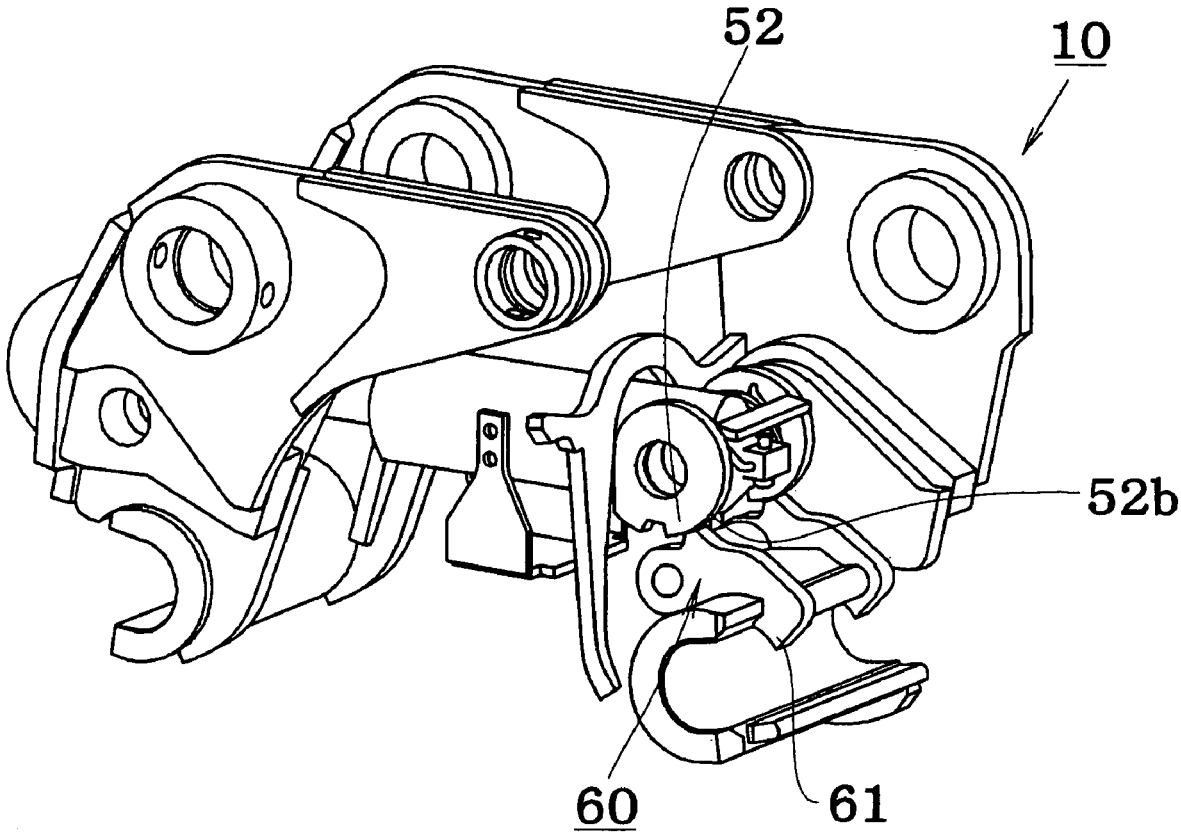
FIG. 7 is an oblique explanatory diagram showing a coupler in a locked state.
Figure 8:
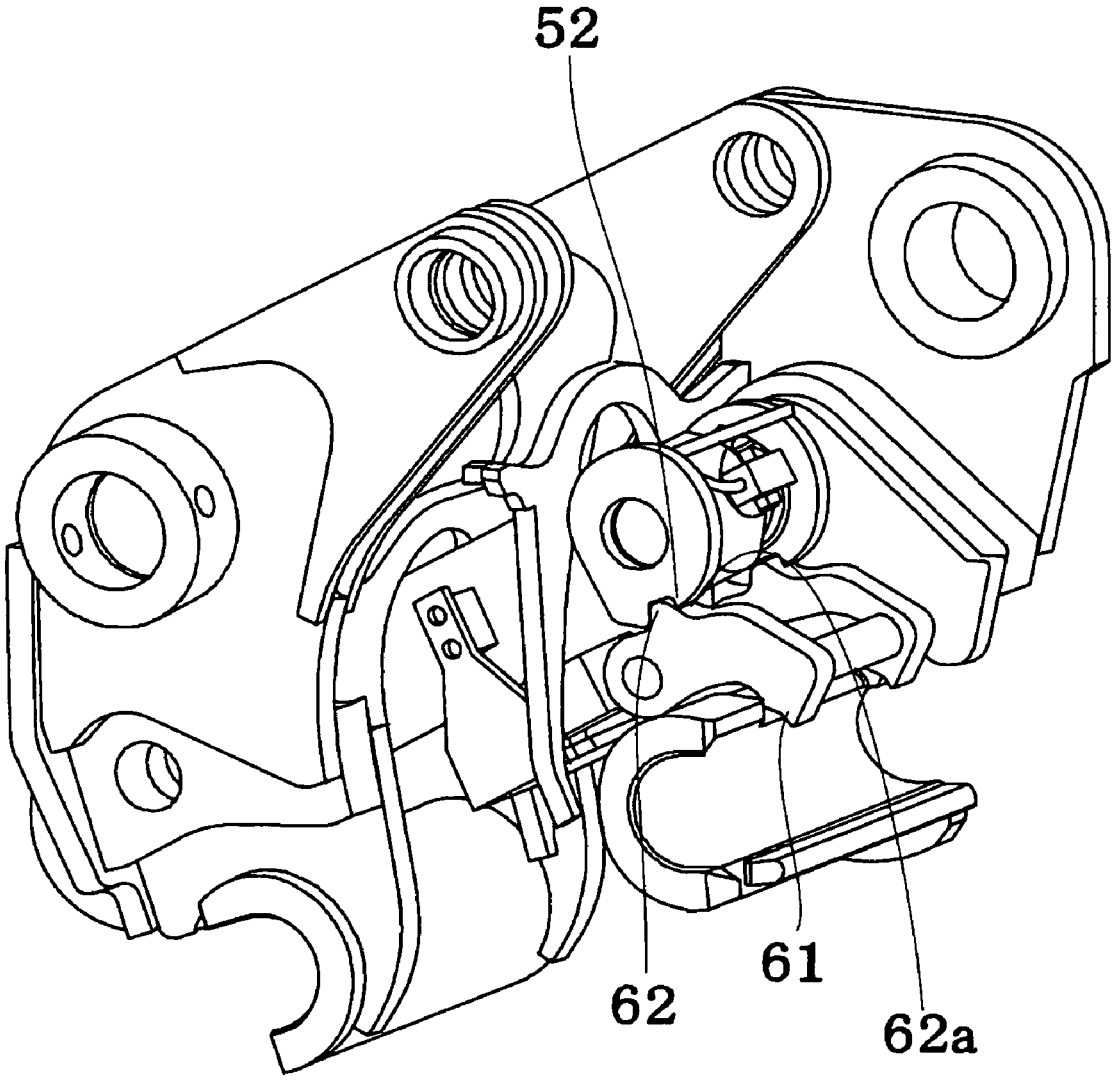
FIG. 8 is an oblique explanatory diagram showing a state in which a protruding portion of a hook of a coupler moves backward.
Figure 9:
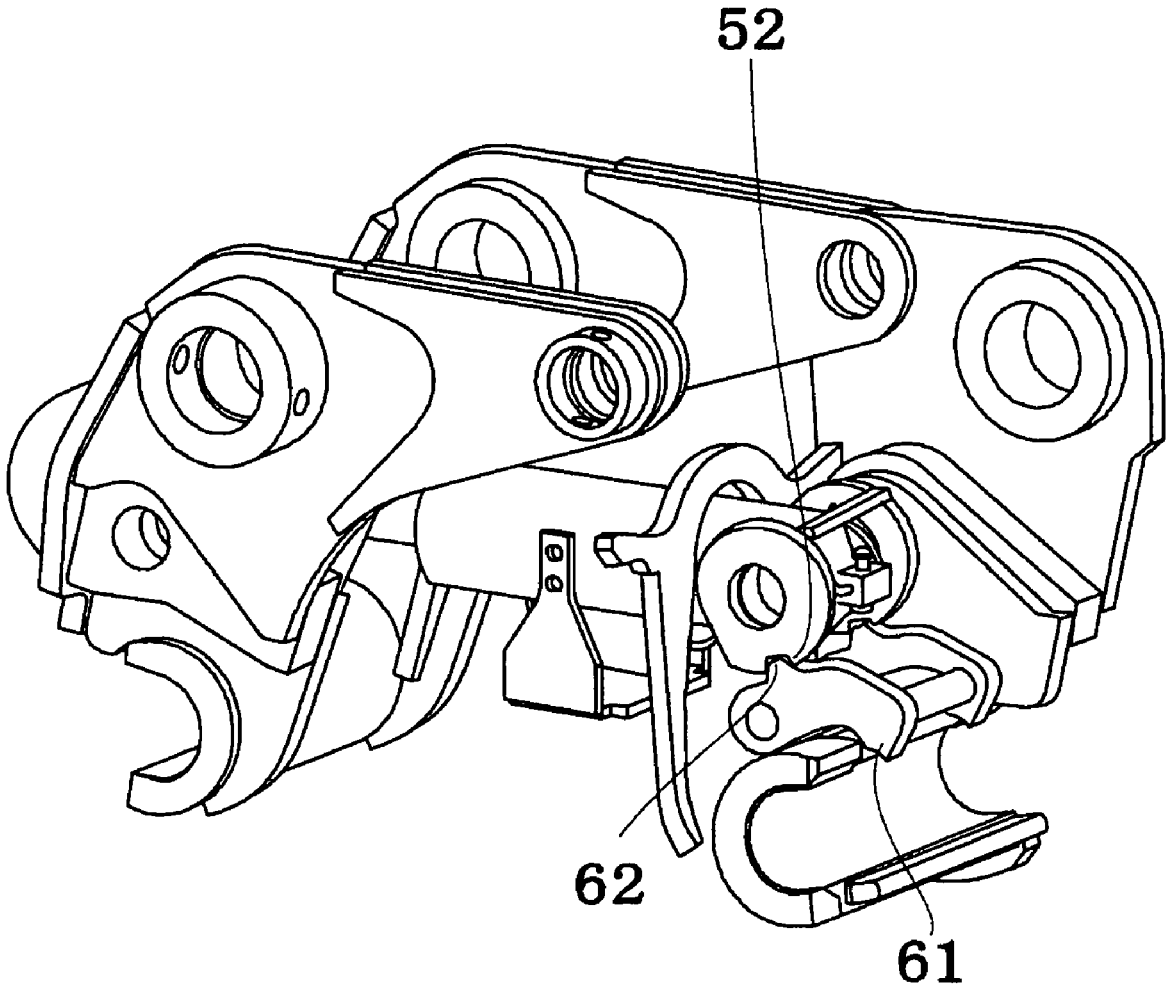
FIG. 9 is a diagram showing a state in which a hook of a coupler does not protrude.
Figure 10:
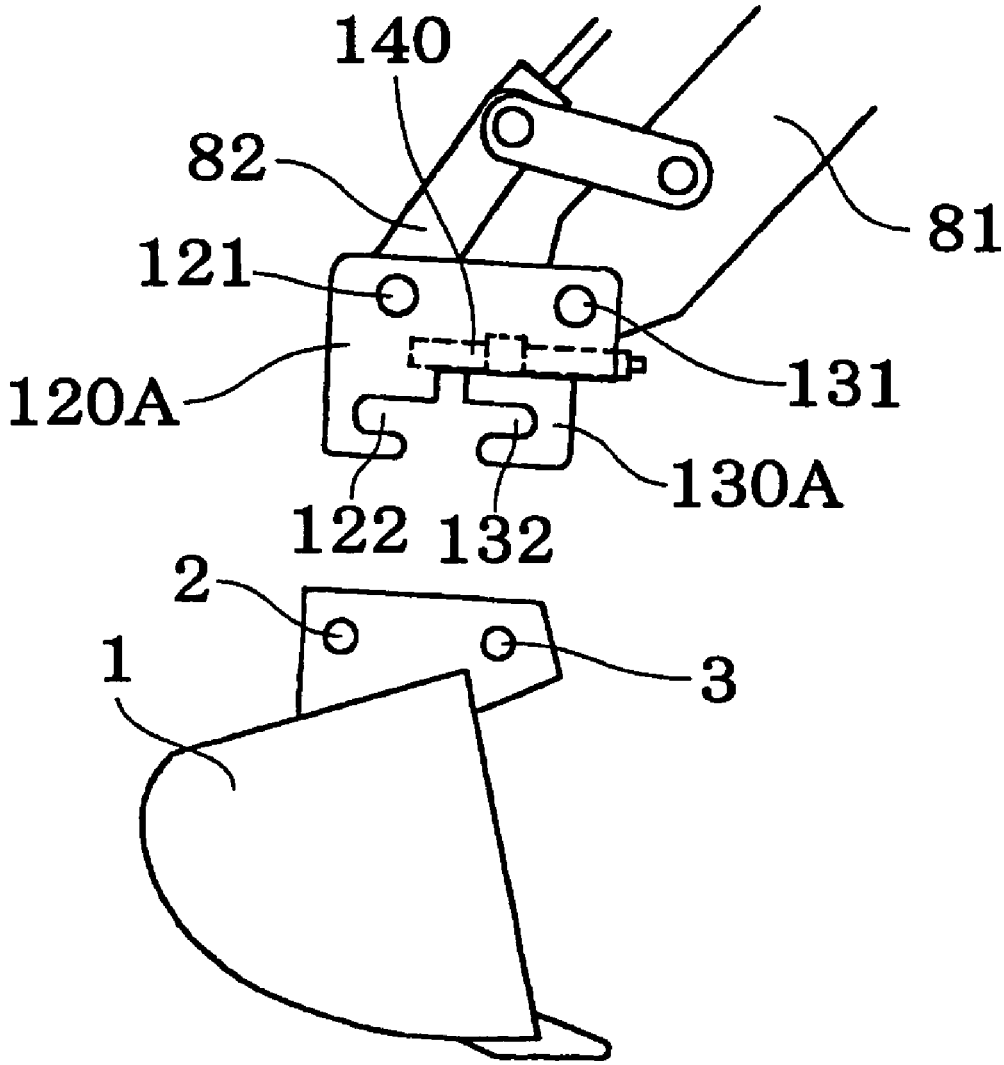
FIG. 10 PRIOR ART
FIG. 10 shows a conventional coupler.
Figure 11:
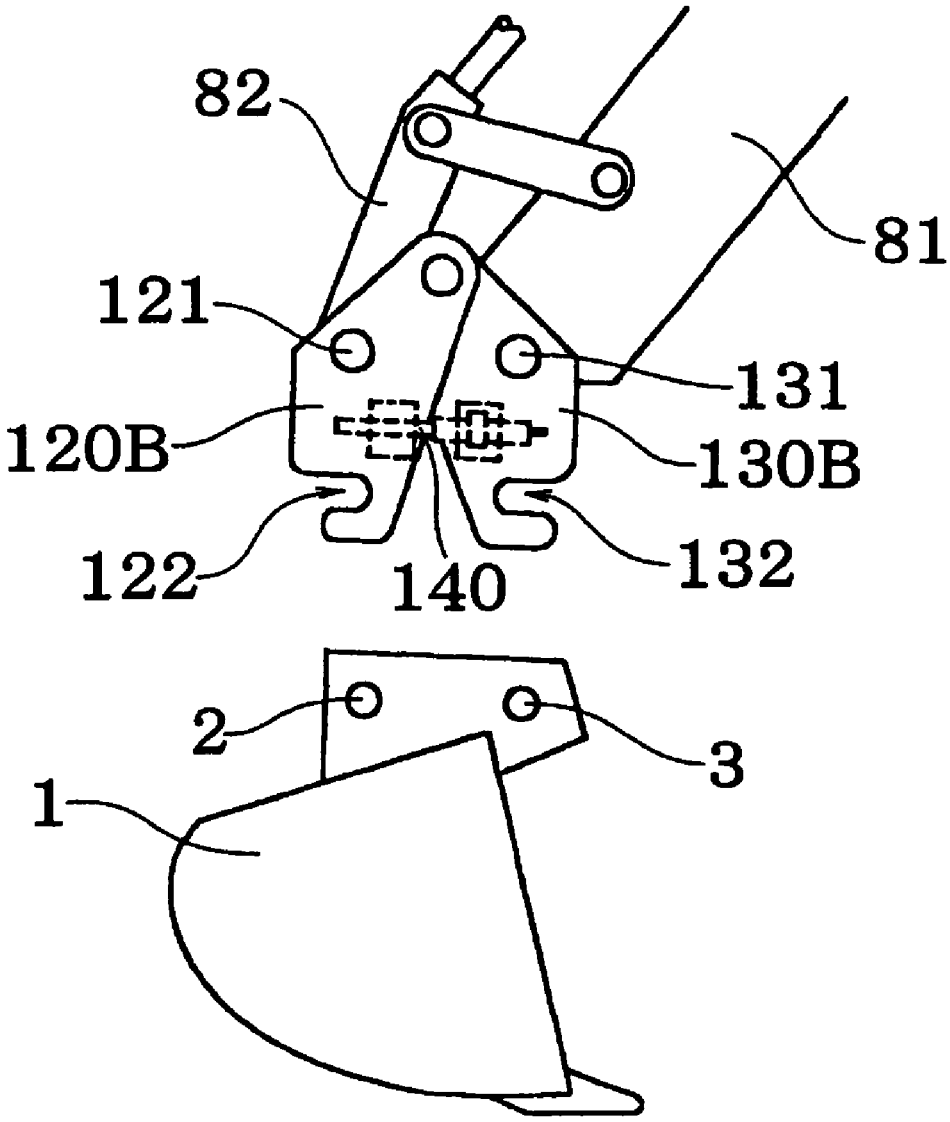
FIG. 11 PRIOR ART
FIG. 11 shows another conventional coupler.

FIG. 8 is an oblique view showing a state in which the protruding portion 61 of the hook 60 moves backward, and FIG. 7 is an oblique view showing a state in which the protruding portion 61 protrudes into the U-shaped portion 32.

An operation when the pin 3 of the attachment 1 does not completely enter the U-shaped portion 32 for some reason is described below with reference to FIGS. 4A to 4E.

Figure 4A:
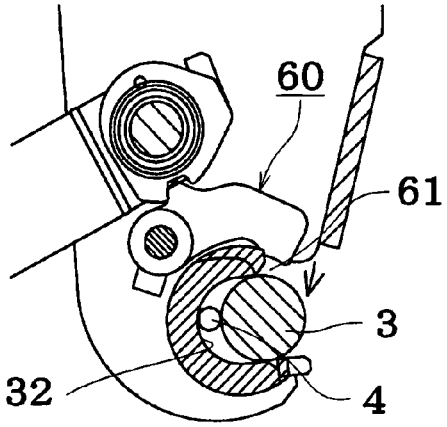
FIGS. 4A to 4E are explanatory diagrams showing the operation of a coupler when foreign matter enters a U-shaped portion of an arm.

FIG. 4A shows a state in which the pin 3 is not completely positioned in the U-shaped portion 32 from the state shown in FIG. 1B due to entrance of foreign matter 4 or the like.

Figure 4D:
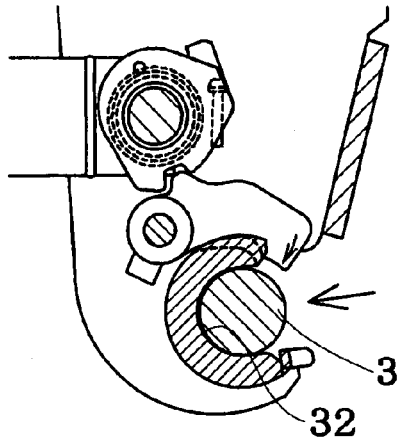
Figure 4B:
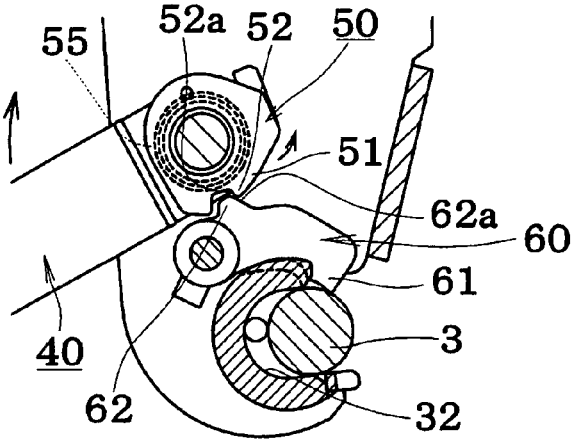

When expanding the expansion-contraction tool 40 in this state, as shown in FIG. 4B, the locking member 50 rotates along with the rotation of the expansion-contraction tool 40 in the horizontal direction.

However, the protruding portion 61 of the hook 60 interferes with the outer circumferential surface of the pin 3, even if the expansion-contraction tool 40 is expanded, in a state in which the pin 3 of the attachment 1 is not completely positioned in the U-shaped portion 32 of the second arm 30. Therefore, the latch protrusion 62 of the hook cannot be removed from the depression 54 of the locking member 50. As a result, the hook portion 62*a* of the hook and the hook portion 52*a* of the locking protrusion 52 of the locking member 50 continue to interfere with each other (see FIG. 4B).

If the expansion-contraction tool 40 is forcibly expanded in this state, the locking protrusion 52 of the locking member 50 or the protruding portion 61 of the hook 60 may break. In this embodiment, the ring 51 of the locking member 50 can freely move rotationally while being biased by the torsion spring 55. Therefore, since the ring 51 rotates counterclockwise, as indicated by the arrows in FIGS. 4B and 4C, against the biasing force of the torsion spring, the depression 54 or the latch protrusion 62 does not break.

Figure 4E:
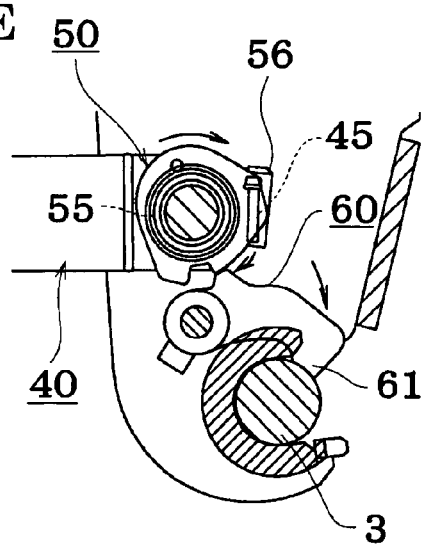
Figure 4C:
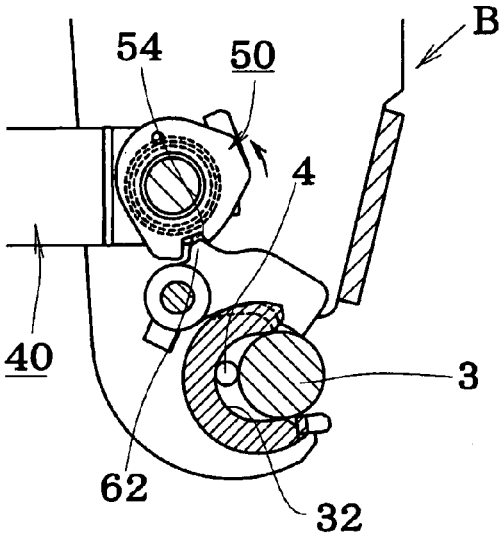

When the foreign matter 4 falls due to vibration or the like, the hook 60 rotates in the direction in which the protruding portion 61 protrudes, as shown in FIGS. 4D and 4E. Therefore, the restriction portion 62*b* provided on the latch protrusion 62 of the hook 60 presses the locking surface 52*b* of the locking protrusion 52 in the same manner as in FIG. 2B, whereby backward movement of the protruding portion 61 is restricted.

This maintains a state in which the protruding portion 61 of the hook 60 continuously protrudes into the U-shaped portion 32.

Figure 5:
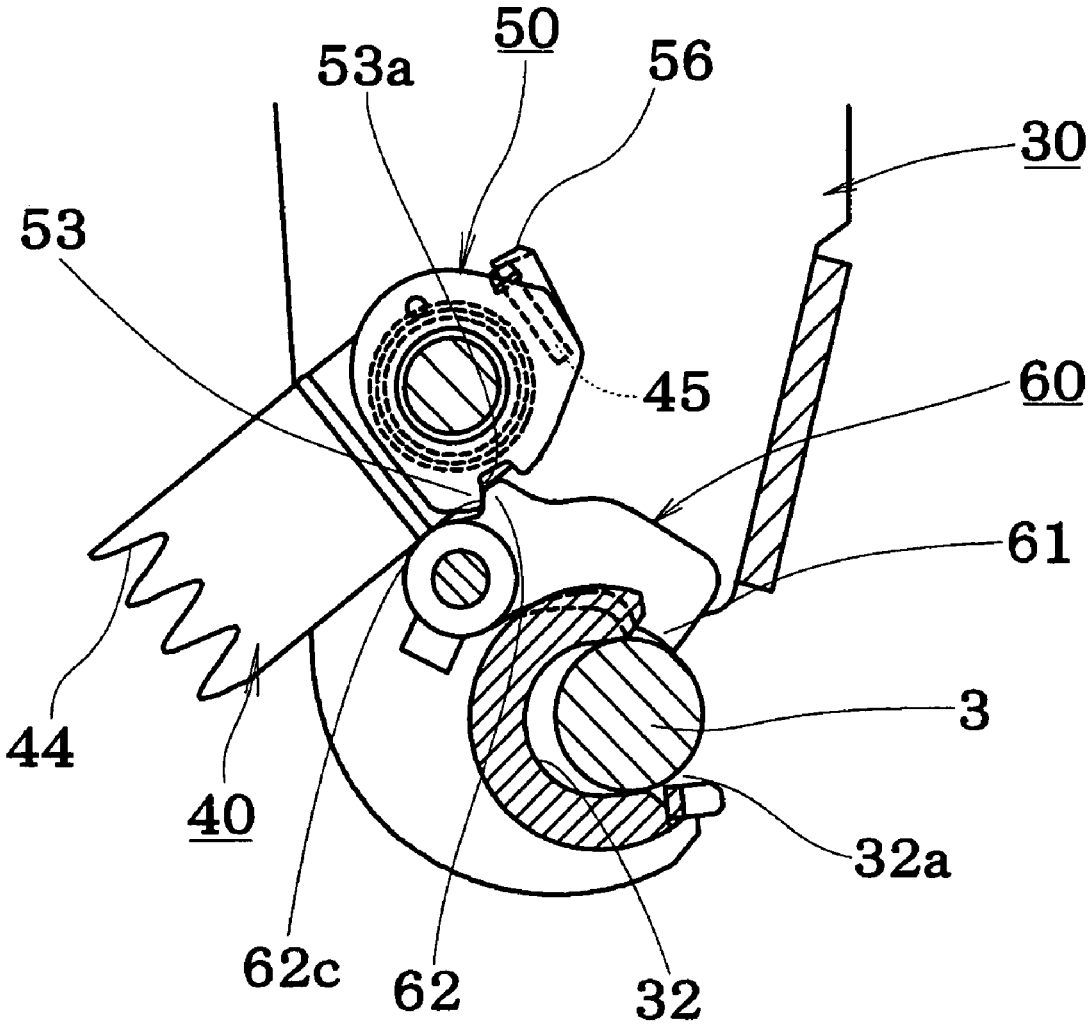
FIG. 5 is an explanatory diagram showing the operation of a coupler when an expansion-contraction tool breaks.

In this embodiment, the latch protrusion 62 of the hook 60 interferes with the stopper protrusion 53 of the locking member. Therefore, when the cylinder of the expansion-contraction tool 40 or the like breaks, as shown in FIG. 5, the stopper surface 53*a* of the stopper protrusion 53 serves as a safety means by pressing the stopper contact portion 62*c* of the latch protrusion 62 of the hook 60 to maintain the protruding state of the protruding portion 61 of the hook 60.

Although only some embodiments of the invention have been described above in detail, those skilled in the art would readily appreciate that many modifications are possible in the embodiments without materially departing from the novel teachings and advantages of the invention. Accordingly, such modifications are intended to be included within the scope of the invention.

What is claimed is:

1. An attachment coupler comprising:

a first arm and a second arm, each of the first arm and the second arm including a U-shaped portion provided on a lower end and having a U-shaped cross section and a pivot shaft provided on an upper side of the U-shaped portion, and upper portions of the first arm and the second arm being swingably connected by a swing shaft;

an expansion-contraction tool of which one end is rotatably supported by the pivot shaft of the first arm and the other end is supported by the pivot shaft of the second arm, and which opens and closes the first arm and the second arm around the swing shaft as a fulcrum due to expansion and contraction;

a locking member which moves rotationally around the pivot shaft of the second arm along with rotation of the expansion-contraction tool, is rotationally biased in a rotational direction around the pivot shaft of the second arm during contraction of the expansion-contraction tool, and includes a cam formed in a peripheral portion; and a hook which includes a base end rotatably supported by the second arm, a free end which advances toward and retreats from an opening of the U-shaped portion of the second arm, and a cam follower which is provided on a peripheral portion between the base end and the free end and contacts the cam;

wherein a state in which the free end of the hook is removed from the opening of the U-shaped portion of the second arm is maintained by engagement of the cam and the cam follower during contraction of the expansion-contraction tool; and wherein the cam follower is driven by the cam along with rotation of the locking member during expansion of the expansion-contraction tool, thereby causing the free end of the hook to advance toward the opening of the U-shaped portion of the second arm.

2. The attachment coupler as defined in claim 1, wherein the cam includes a depression; and wherein the cam follower includes a latch protrusion which enters the depression of the locking member in a state in which the expansion-contraction tool is contracted.

3. The attachment coupler as defined in claim 2, wherein the cam further includes a stopper protrusion and a locking protrusion, the depression being formed between the stopper protrusion and the locking protrusion;

wherein the latch protrusion which has entered the depression of the locking member in a state in which the expansion-contraction tool is contracted contacts the stopper protrusion to restrict rotation of the hook; and wherein the latch protrusion which has been removed from the depression of the locking member in a state in which the expansion-contraction tool is expanded is pressed by the locking protrusion to cause the free end of the hook to advance toward the opening of the U-shaped portion of the second arm.

4. The attachment coupler as defined in claim 2, wherein the hook is rotationally biased in a direction in which the free end moves away from the opening of the U-shaped portion of the second arm.

5. The attachment coupler as defined in claim 1, comprising:

a torsion spring of which one end is supported by a spring mounting portion provided on the expansion-contraction tool and the other end is supported by the locking member.

6. The attachment coupler as defined in claim 5, wherein the torsion spring goes around the pivot shaft of the second arm.

7. The attachment coupler as defined in claim 1, wherein each of the first arm and the second arm includes a connecting portion respectively connectable to an arm and a front link of a working machine.

* * * * *